US005332036A

United States Patent [19]

Shirley et al.

[11] Patent Number: 5,332,036

[45] Date of Patent: Jul. 26, 1994

[54] METHOD OF RECOVERY OF NATURAL GASES FROM UNDERGROUND COAL FORMATIONS

[75] Inventors: Arthur I. Shirley, Piscataway; Ramakrishnam Ramachandran, Allendale, both of N.J.

[73] Assignee: The BOC Group, Inc., Murray Hill, N.J.

[21] Appl. No.: 986,842

[22] Filed: Dec. 4, 1992

Related U.S. Application Data

[63] Continuation-in-part of Ser. No. 883,504, May 15, 1992, abandoned.

[51] Int. Cl.[5] ..... E21B 43/00

[52] U.S. Cl. ..... 166/268; 166/274; 299/12

[58] Field of Search ..... 299/4, 7, 10, 12; 166/245, 266, 271, 272, 274, 268

[56] References Cited

U.S. PATENT DOCUMENTS

| | | | |
|---|---|---|---|
| 4,043,395 | 8/1977 | Every et al. | 166/268 X |
| 4,883,122 | 11/1989 | Puri et al. | 166/268 X |
| 5,074,357 | 12/1991 | Haines | 166/268 X |
| 5,085,274 | 2/1992 | Puri et al. | 166/245 X |
| 5,099,921 | 3/1992 | Puri et al. | 299/10 X |

*Primary Examiner*—David J. Bagnell

*Attorney, Agent, or Firm*—Coleman R. Reap; Larry R. Cassett

[57] ABSTRACT

Methane is produced from a coal seam penetrated by an injection well and a gas production well by first introducing liquefied or gaseous carbon dioxide through the injection well and into the coal seam and subsequently introducing a weakly adsorbable gas through the injection well and into the coal seam. As the weakly adsorbable gas passes through the coal seam, it forces the carbon dioxide through the seam. If the carbon dioxide is in liquefied form, it evaporates as it moves through the seam, and the carbon dioxide gas desorbs methane from the coal and sweeps it toward the production well. The methane is withdrawn from the seam through the production well.

12 Claims, 1 Drawing Sheet

METHOD OF RECOVERY OF NATURAL GASES FROM UNDERGROUND COAL FORMATIONS

This is a continuation-in-part of Application Ser. No. 07/883,504, filed May 15, 1992 now abandoned.

BACKGROUND OF THE INVENTION

This invention relates to the production of gases from underground mineral formations, and more particularly to the enhanced production of natural gas or the components of natural gas from an underground coal formation using a strongly adsorbable fluid and a weakly adsorbable gas in combination to stimulate release of the desired gases.

Underground coal formations and other such carbon deposits contain natural gas components, such as the lower molecular weight hydrocarbons, due to effects of long term coalification. Coal generally has a low porosity, hence most of the coalbed gas is in the form of sorbate on the surfaces of the coal rather than being entrapped within the coal. The gas is present in the coal deposit in significant quantities; accordingly it is economically desirable to extract them for use as fuel and for other industrial purposes.

Coalbed gas is conventionally produced from underground coal deposits by pressure depletion. According to one technique for practicing this procedure, a well is drilled into the coal deposit and a suction is applied to the well withdraw the gas from the deposit. Unfortunately water gradually enters the coal deposit as the pressure in the deposit decreases, and as the water accumulates in the deposit, it hinders withdrawal of gas from the deposit. The drop in pressure as the process proceeds, and complications caused by the influx of water into the deposit, lead to a rapid decrease in the gas production rate and eventual abandonment of the effort after a relatively low recovery of the coalbed gas.

To avoid the difficulties of the above-described pressure depletion method attempts to recover gases from a coal deposit by injecting gaseous carbon dioxide into the deposit have been made. The carbon dioxide is injected into the coal deposit through an injection well which penetrates the deposit. The advantage of this procedure is that the carbon dioxide displaces the desired gas from the surfaces of the coal and sweeps it toward a production well which has also been drilled into the deposit, but at a distance from the injection well. Although this method affords a greater recovery of the coalbed gas than the pressure depletion method, it is prohibitively costly because large volumes of carbon dioxide are required to effect a reasonable recovery of the gas from the deposit.

It is also known to inject an inert gas, such as nitrogen or argon, into the coal deposit to force the coalbed gas from the coal deposit. This procedure is disclosed in U.S. Pat. 4,883,122. The method of recovery has the disadvantage that the inert gas is not adsorbed onto the coal; hence it does not easily desorb the coalbed gases. Consequently, although the inert gas does sweep some coalbed gas from the deposit, the inert gas is removed from the deposit with the coalbed gas. The presence of the inert gas in the coalbed gas removed from the deposit reduces its value as a fuel.

Because of the value of the coalbed gas, methods for the efficient recovery of coalbed gas from coal deposits which are free of the above-noted disadvantages of prior art recovery techniques are constantly sought. This invention provides such an improved method.

SUMMARY OF THE INVENTION

According to the invention, gaseous substances, such as lower molecular weight hydrocarbons and other components of natural gas, are released and recovered from an underground solid carbonaceous deposit, such as a coal deposit, by a two-step process comprising injecting first a strongly adsorbable fluid and then a weakly adsorbable gas into the deposit. Movement of the fluid through the deposit effects the release of the gaseous substances from the deposit and forces them toward a collection point from which they are recovered. The fluid is preferably liquefied carbon dioxide. The weakly adsorbable gas is preferably nitrogen, argon, helium or air.

BRIEF DESCRIPTION OF THE DRAWINGS

The invention is illustrated in the drawings, in which.

In the drawings like characters designate like or corresponding parts throughout the several views. Auxiliary valves, lines and equipment not necessary for an understanding of the invention have been omitted from the drawings.

DETAILED DESCRIPTION OF THE INVENTION

Figure 1:
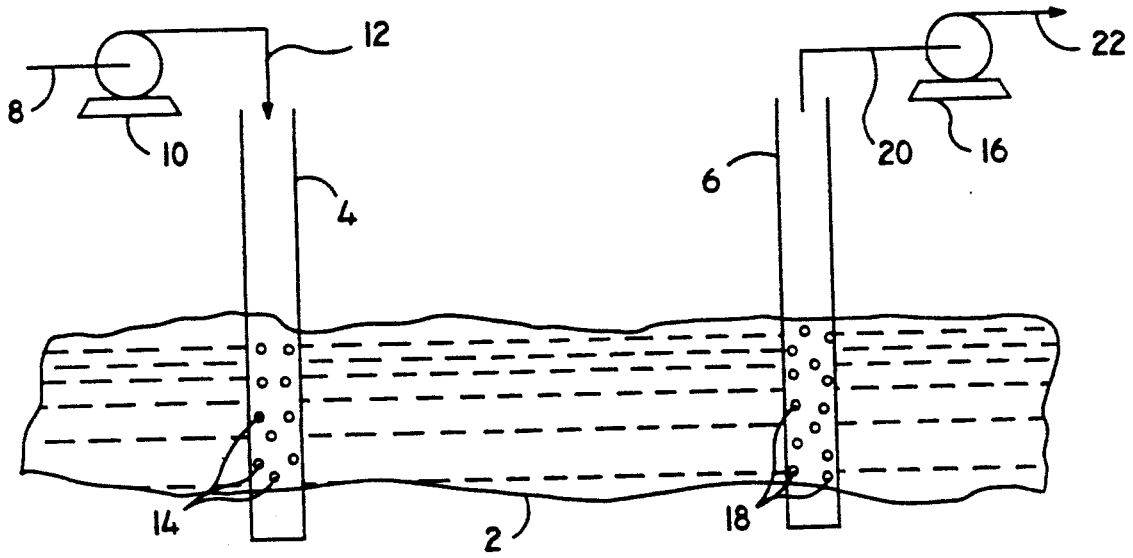
FIG. 1 is a side elevation of a subterreanean formation containing a solid carbonaceous deposit, wherein the deposit is penetrated by an injection well and a production well.

According to the invention, gaseous substances, such as natural gas components, that are adsorbed onto the surfaces of subterranean solid carbonaceous formations, such as coal deposits, or which are otherwise trapped in the formation, are released from the formation and forced to the surface of the earth by injecting a strongly adsorbable fluid stream comprising one or more strongly adsorbable fluids into the formation and then injecting a gas stream comprising one or more weakly adsorbable gases into the formation in a manner such that the weakly adsorbable gas stream forces the strongly adsorbable fluid(s) to move through pores, cracks and seams in the formation toward a gas collection point in or at the end of the formation. When the fluid stream comprising the one or more strongly adsorbable components is injected into the deposit it facilitates release of the gaseous substances adsorbed or trapped therein. When the gas stream comprising the one or more weakly adsorbable gases is injected into the deposit it forces the strongly adsorbable fluid stream to move through the formation ahead of the weakly adsorbable gas stream. If the strongly adsorbable fluid stream is in the form of a liquid, as it moves through the formation, which is often at a temperature of about 35° to 60° C. or more, all or a portion of liquid fluid likely vaporizes. When this occurs, the vapor moves through the formation, and as it does so it desorbs the gaseous substances therefrom and sweeps them toward the gas collection point. At the collection point the desorbed gaseous substances, which may be mixed with the vapors, are withdrawn from the formation.

The gaseous substances recovered by the process of the invention are the gases that are normally found in underground solid carbonaceous formations such as coal deposits. These include the components of natural gas, which is made up mostly of lower molecular weight hydrocarbons, i.e. hydrocarbons having from 1 to about 6 carbon atoms. The most prevalent hydrocarbons in such natural gas are those having up to 3 hydrocarbons, and by far the most highly concentrated hydrocarbon present is methane. Other gases, such as nitrogen, may also be present in the formation in small concentrations.

The strongly adsorbable fluid used in the process of the invention may be any gas, liquefied gas or volatile liquid that is nonreactive and which is more strongly adsorbed by the carbonaceous matter in the formation than are the gaseous substances that are to be recovered from the formation. By nonreactive is meant that the fluid does not chemically react with the carbonaceous matter or the gaseous substances present in the formation at the temperatures and pressures prevailing in the formation. It is preferred to use liquefied gases or volatile liquids that rapidly evaporate at the conditions existing in the underground formation. Liquefied carbon dioxide is preferred for use in the process of the invention because it is easily liquefied and is more strongly adsorbed onto the carbonaceous material than are the gaseous substances which it is desired to recover, hence it efficiently desorbs the gaseous substances from the coal as it passes through the bed. Carbon dioxide has the additional advantages that it evaporates at the temperatures and pressures usually prevailing in the formation, thereby forming the more efficiently adsorbed gas phase, and it is easily separated from the recovered gaseous substances because its boiling point is high relative to the boiling points of the recovered gaseous substances. Because of the latter advantage, it can be separated from the recovered formation gases by cooling the gas mixture sufficiently to condense the carbon dioxide. The liquefied carbon dioxide recovered by condensation can be reused in the process of the invention.

As indicated above, the strongly adsorbable fluid stream may be comprised substantially of a single strongly adsorbable component, or it may comprise a mixture of two or more strongly adsorbable components. The presence of minor amounts of weakly adsorbable gases in the strongly adsorbable fluid stream will not prevent the strongly adsorbable fluid from performing its intended function in the process of the invention. However, since the principle benefit is derived fron the strongly adsorbable component(s), the strongly adsorbable component(s) are present as the major components of this stream. In general, it is preferred that the strongly adsorbable component(s) comprise at least 75 and most preferably at least 90 volume percent of the strongly adsorbable fluid stream. Typical strongly adsorbable component streams comprise substantially pure carbon dioxide or mixtures of carbon dioxide as the major component and a weakly adsorbable gas, such as nitrogen, argon or oxygen, as a minor component.

The weakly adsorbable gas used in the process of the invention can be any gas or mixture of gases that is nonreactive, i.e. it does not chemically react with the carbonaceous material or the gaseous substances contained in the formation at the temperatures and pressures prevailing in the formation. Preferred weakly adsorbable gases are those that are not readily adsorbed onto the surfaces of the carbonaceous material. Typical gases that can be used as the weakly adsorbable gas in the process of the invention are nitrogen, argon, helium, carbon dioxide, air, nitrogen-enriched air and mixtures of two or more of these. Nitrogen and nitrogen-enriched air are the most preferred weakly adsorbable gases because they are less expensive and more readily available than argon and helium and safer to use than air. As was the case with the strongly adsorbable fluid stream, the weakly adsorbable gas stream may contain minor amounts of strongly adsorbable gases, such as carbon dioxide. However, since strongly adsorbable gases perform no useful function in the weakly adsorbable gas stream it is preferred that the concentration of these gases in this stream be kept to a minimum.

The process of the invention can be used to produce gases from any solid underground carbonaceous formation. Typical carbonaceous deposits from which valuable fuel gases can be produced are anthracite, bituminous and brown coal, lignite, peat, etc.

To prepare an underground formation for recovery of the desired gaseous substances by the process of the invention, provision is made for introducing strongly adsorbable fluid and weakly adsorbable gas into the formation and for withdrawing the desired gaseous substances therefrom. This can be conveniently accomplished by drilling one or more injection wells and one or more production wells into the formation. A single injection well and a single product well can be used, however it is usually more effective to provide an array of injection wells and production wells. For example, injection wells can be positioned at the corners of a rectangular section above the formation and a production well can be positioned in the center of the rectangle. Alternatively, the gas production field can consist of a central injection well and several production wells arranged around the injection well or a line-drive pattern, i.e. alternating runs of injection wells and production wells. The arrangement of the gas recovery system is not critical and forms no part of the invention. For simplicity the invention will be described as it applies to the extraction of methane from a coal deposit using a single injection well, a single gas production well, liquefied carbon dioxide as the strongly adsorbably fluid and nitrogen as the weakly adsorbable gas. It is to be understood, however, that the invention is not limited to this system.

Considering first FIG. 1, illustrated therein is a coal deposit, 2, which is penetrated by injection well 4 and gas production well 6. Line 8 carries the fluid to be injected into the coal deposit from a source (not shown) to pump 10, which raises the pressure of the fluid being injected into the coal deposit sufficiently to enable it to penetrate the deposit. The high pressure fluid is carried into well 4 via line 12. The fluid in well 4 passes through the wall of well 4 through openings 14. Methane is withdrawn from the coal deposit by pump 16. The methane enters well 6 through openings 18, rises to the surface through well 6 and enters pump 16 via line 20. The methane is discharged from pump 16 to storage or to a product purification unit (not shown) through line 22.

Figure 2:
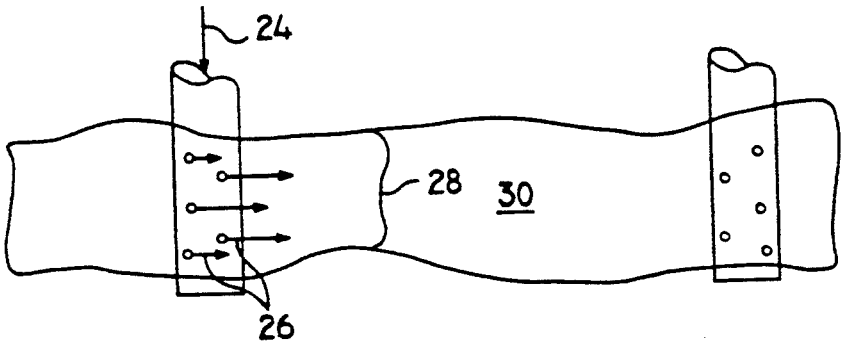
FIG. 2 is a side elevation of the formation of FIG. 1, after liquefied gas has been injected into the deposit illustrated therein.

FIG. 2 illustrates the first step of the process of the invention. During this step liquefied carbon dioxide is pumped into coal deposit 2. The direction of movement of the liquefied carbon dioxide through well 4 is represented by arrow 24 and the direction of flow of the liquefied carbon dioxide into the coal deposit is represented by arrows 26. It appears that the liquefied carbon dioxide passing through the coal deposit forms a front, represented by reference numeral 28. As the liquefied carbon dioxide moves through the coal deposit it stimulates the release of methane from the deposit. It is not known with certainty how this is accomplished, but it is believed that this effect is perhaps caused by a combination of factors, such as fracturing of the coal deposit structure from the force of the liquefied gas in the pores of the coal and expansion of seams in the coal deposit. It appears likely that some of the liquefied carbon dioxide is vaporized as it passes through the warm formation and that some methane is desorbed from the coal by the vaporized carbon dioxide and some is desorbed by the liquefied carbon dioxide. In any event the methane is swept through the coal deposit by the carbon dioxide. In FIG. 2, the methane concentrates ahead of front 28, in the region represented by reference numeral 30.

Figure 3:
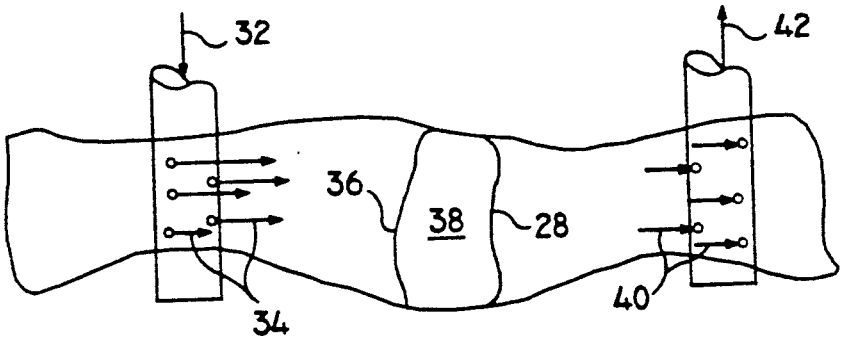
FIG. 3 is a side elevation of the formation shown in FIG. 1 after liquefied gas and weakly adsorbable gas have been injected into the deposit illustrated therein.

The second step of the invention is illustrated in FIG. 3. In this step nitrogen is pumped into the coal deposit after the desired amount of liquefied carbon dioxide is pumped into the deposit. The flow of nitrogen through well 4 is represented by arrow 32, and the flow of nitrogen into coal deposit 2 is represented by arrows 34. It is theorized that as the nitrogen passes through the coal deposit it forms a front 36 behind the body of liquefied carbon dioxide, the latter of which is represented by reference numeral 38. The body of liquefied carbon dioxide appears to act as a buffer between the methane and the nitrogen, thereby tending the inhibit mixing of the nitrogen with the methane being recovered from the deposit. Again, the reason for this is not known, but it appears that a possible explanation for this effect is that frothing of the liquefied carbon dioxide may result at the liquefied carbon dioxide-nitrogen interface, and the froth may to some extent interfere with the passage of the nitrogen into the liquefied carbon dioxide. The flow of methane released from the deposit into production well 6 is represented by arrows 40, and the flow of the methane through well 6 is represented by arrow 42.

The invention is further exemplified by the following hypothetical examples, in which parts, percentages and ratios are on a weight basis, unless otherwise indicated.

EXAMPLE I

Injection and production wells are drilled into a coal seam containing adsorbed methane in a repeating line-drive pattern having a well-to-well distance of 1000 ft. Liquefied carbon dioxide is then injected into the coal seam through the injection wells, until a total of 15,000 bbl. per well is injected into the seam. Next, nitrogen is injected into the coal seam through the injection wells as a propellant gas. As the nitrogen is pumped into the wells, a methane-rich gas stream is removed from the seam through the production wells. When about 3.6 ($10^6$) standard cubic feet (scf) per well of nitrogen has been injected into the coal seam, the concentration of nitrogen in the product stream will begin to increase, indicating that break-through of the nitrogen propellant gas will have occurred. At this point the volume of methane removed from the coal seam will have reached about 42.9 ($10^6$) scf per well.

EXAMPLE II (COMPARATIVE)

The procedure of Example I is repeated except that no nitrogen propellant gas is injected into the coal seam. The total volume of methane removed from the coal seam will be about 23.7 ($10^6$) scf per well.

EXAMPLE III

The procedure of Example I is repeated except that no liquefied carbon dioxide is injected into the coal seam. At the point of nitrogen break-through, 3.0 ($10^6$) scf per well of nitrogen will have been injected into the coal seam and the volume of methane removed from the well will have reached about 15.9 ($10^6$) scf per well.

Examination of the above examples shows that the volume of methane recovered from the coal seam is considerably greater when first liquefied carbon dioxide and then nitrogen are injected into the coal seam to force methane from the coal seam than when either liquefied carbon dioxide or nitrogen are used alone to force the methane from the coal seam.

Although the invention is described with reference to a specific example, the scope of the invention is not limited thereto. For example, the invention can be used to recover valuable gases from carbonaceous deposits other than coal. Also, as earlier noted, the invention can be practiced using strongly adsorbable fluids other than liquefied carbon dioxide and weakly adsorbable gases other than nitrogen. The scope of the invention is limited only by the breadth of the appended claims.

What is claimed is:

1. A process for recovering an adsorbed fuel gas from an underground deposit comprising:

(a) injecting a first stream comprising as major components one or more strongly adsorbable fluids into said deposit;

(b) injecting a second stream comprising one or more weakly adsorbable gases into said deposit, thereby causing said one or more strongly adsorbable components to flow through said deposit and desorb said fuel gas therefrom; and (c) withdrawing said fuel gas from said deposit.

2. The process of claim 1, wherein said deposit is a carbonaceous deposit.

3. The process of claim 2, wherein said carbonaceous deposit is selected from coal, lignite, peat and mixtures thereof.

4. The process of either of claims 1 or 2, wherein said fuel gas is natural gas.

5. The process of claim 4, wherein said natural gas is comprised of one or more hydrocarbons have 1 to 5 carbon atoms.

6. The process of claim 5, wherein said one or more hydrocarbons have 1 to 3 carbon atoms.

7. The process of either of claims 1 or 2, wherein said fuel gas is comprised substantially of methane.

8. The process of either of claims 1 or 2, wherein said first stream comprises carbon dioxide as the major component.

9. The process of claim 8, wherein said first stream additionally comprises nitrogen.

10. The process of claim 8, wherein said second stream comprises as the major component one or more gases selected from nitrogen, helium, argon, air and mixtures of these.

11. The process of claim 8, wherein said second stream comprises nitrogen as the major component.

12. A process for producing methane from an underground coal deposit penetrated by an injection well and a production well comprising:

(a) injecting liquefied carbon dioxide into said coal deposit through said an injection well;

(b) injecting nitrogen into said coal deposit through said injection well, thereby causing said liquefied carbon dioxide to penetrate into said coal deposit and desorb methane therefrom; and (c) withdrawing methane from said coal deposit through said production well.

* * * * *